United States Patent [19]

Kono et al.

[11] 4,076,410

[45] Feb. 28, 1978

[54] PHOTORECEPTOR DRUM FOR USE IN ELECTROPHOTOGRAPHIC COPYING APPARATUS

[75] Inventors: Tateomi Kono, Toyokawa; Takashi Kuwako, Okazaki, both of Japan

[73] Assignee: Minolta Camera Kabushiki Kaisha, Osaka, Japan

[21] Appl. No.: 718,937

[22] Filed: Aug. 30, 1976

[30] Foreign Application Priority Data

Oct. 3, 1975 Japan ..... 50-135853
Aug. 2, 1976 Japan ..... 51-104840

[51] Int. Cl.[2] ..... G03G 15/00
[52] U.S. Cl. ..... 355/16; 242/67.3 R
[58] Field of Search ..... 355/16, 3 BE, 3 R, 133, 355/3 DR

[56] References Cited

U.S. PATENT DOCUMENTS 4,004,752 1/1977 Kayama ..... 242/198

FOREIGN PATENT DOCUMENTS 2,444,913 3/1975 Germany ..... 355/16
2,338,340 2/1974 Germany ..... 355/16

*Primary Examiner*—Richard L. Moses
*Attorney, Agent, or Firm*—Wenderoth, Lind & Ponack

[57] ABSTRACT

A photoreceptor drum for use in an electrophotographic copying apparatus which includes a sheet-like photoreceptor stored in roll form on a supply roll housed within the drum and led therefrom around the outer periphery of the drum through a slot axially formed in the drum surface so as to be wound onto a takeup roll also housed within the drum for enabling the photoreceptor on the drum to be replaced when wound onto the takeup roll. The drum is provided with a covering member for the slot which can be raised from the photoreceptor surface during replacement of the photoreceptor, and the raising of the covering member is associated with releasing of locking of the supply roll.

12 Claims, 13 Drawing Figures

PHOTORECEPTOR DRUM FOR USE IN ELECTROPHOTOGRAPHIC COPYING APPARATUS

The present invention relates to an electrophotographic copying apparatus and more particularly, to a photoreceptor drum for use in an electrophotographic copying apparatus which includes a sheet-like photoreceptor stored in roll form on a supply roll housed within the drum and led therefrom around the outer periphery of the drum through a slot axially formed in the drum surface so as to be wound onto a takeup roll also housed within the drum, so that the portion of the photoreceptor extending along the major portion of the drum periphery for serving as the photoreceptor layer can be renewed upon advancing of the photoreceptor from the supply roll to the takeup roll.

Such a photoreceptor generally comprises, for example, a film base of polyester, an electrically conductive material layer such as aluminum layer deposited on said film base, a selenium layer deposited on said electrically conductive material layer, and another layer of PVK (polyvinylcarbazole) further applied onto said selenium layer. The prior art photoreceptor of the above described type on which an electrostatic latent image of an original to be copied is formed in a manner well known in the art is subjected to fatigue due to deterioration of the photosensitive characteristics thereof through repeated use. Since high copying quality can not be expected with the photoreceptor thus fatigued, the photoreceptor must inevitably be replaced with new one, in which case, employment of the photoreceptor drum incorporating therein the above described sheet-like photoreceptor is advantageous for efficient replacement.

Commonly, in the photoreceptor drum of the above described type in which a fresh portion of the sheet-like photoreceptor is paid out in a predetermined amount from the supply roll onto the major portion of the outer periphery of the drum upon fatigue of the photoreceptor, there has been such a disadvantage that foreign matter such as toner particles, dust and dirt tend to enter the interior of the drum through the axial slot formed in the drum for advancing the photoreceptor sheet.

Figure 1:
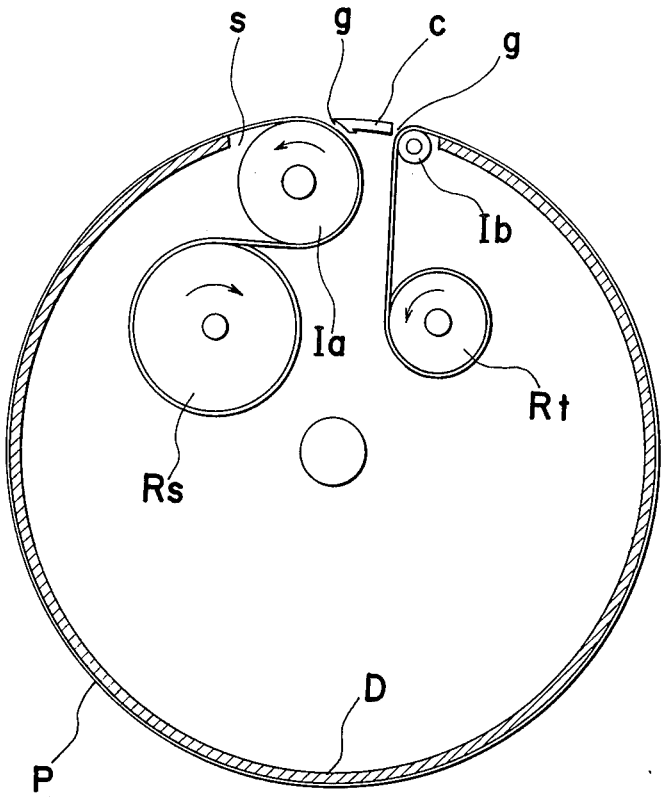
FIG. 1 Prior Art

In order to cope with such drawbacks, there has conventionally been proposed an arrangement as shown in FIG. 1, in which the photoreceptor sheet P stored on the supply roll R*s* within the drum D is drawn around the major portion of the outer periphery of the drum D via an idler roller I*a* through the slot S axially formed in the drum surface and is wound onto the takeup roll R*t* via another idle roller I*b*, while a cover plate member C extending the length of the slot S is fixedly disposed within the slot S for preventing toner particles and other foreign matter from entering the interior of the drum D. In the known arrangement as described above, however, some clearance *g* is inevitably required between the cover plate member C and the photoreceptor sheet P for advancing the photoreceptor sheet without damages, through which clearance *g*, toner particles and the like enter the interior of the drum D, thus soiling the unused portion of the photoreceptor sheet S stored on the supply roll R*s* or again scattering out of the drum D to soil copy paper sheets and other parts of the copying apparatus.

Accordingly, an essential object of the present invention is to provide a photoreceptor drum for use in an electrophotographic copying apparatus which is equipped with a photoreceptor replacing arrangement capable of perfectly preventing toner particles and the like from entering the interior of the photoreceptor drum without any damage to the photoreceptor even when the photoreceptor is to be replaced.

Another important object of the present invention is to provide a photoreceptor drum equipped with a photoreceptor replacing arrangement of the above described type which is accurate in its functioning and highly reliable, with substantial elimination of disadvantage of the conventional photoreceptor replacing arrangement.

A further object of the present invention is to provide a photoreceptor drum equipped with a photoreceptor replacing arrangement of the above described type which is simple in construction and readily incorporated into copying apparatuses.

According to a preferred embodiment of the present invention, the photoreceptor drum includes a rotatory cylindrical drum having a slot axially formed in the outer periphery thereof, a supply roll and a takeup roll rotatably disposed in the cylindrical drum, a sheet-like photoreceptor normally stored on the supply roll and drawn out therefrom through said slot and along the outer periphery of the cylindrical drum as to be wound onto the takeup roll for replacement of the used portion of the photoreceptor upon rotation of the takeup roll, and a covering member for covering the slot which is movable between a first position to close said slot and a second position to open said slot. The photoreceptor drum is further provided with means for moving said covering member between the first and second positions, which moving means raises the covering member to the second position during the replacement of said sheet-like photoreceptor, lock means for preventing rotation of the supply roll, and means for associating releasing of the lock means with the operation of the moving means for raising the covering member so as to enable the photoreceptor to smoothly advance without any damage for the replacement of the sheet-like photoreceptor. In the above arrangement, since the covering member for closing the slot can be raised from the slot and the supply roll for the photoreceptor has lock means for associating the raising of the covering member with the lock releasing operating of the lock means, the replacement of the photoreceptor is effected without any danger of damage to the photoreceptor, while the photoreceptor drum is perfectly protected against entry of foreign matter thereinto during use by virtue of the covering member closely contacting the photoreceptor within the slot, with substantial elimination of the disadvantages inherent in the conventional photoreceptor drum of the kind.

Figure 2:
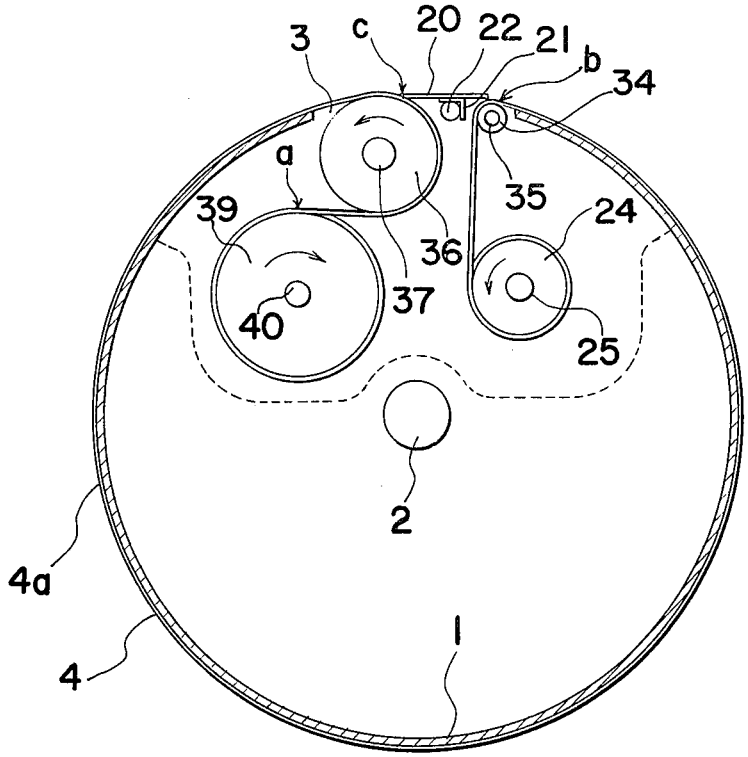
Figure 3:
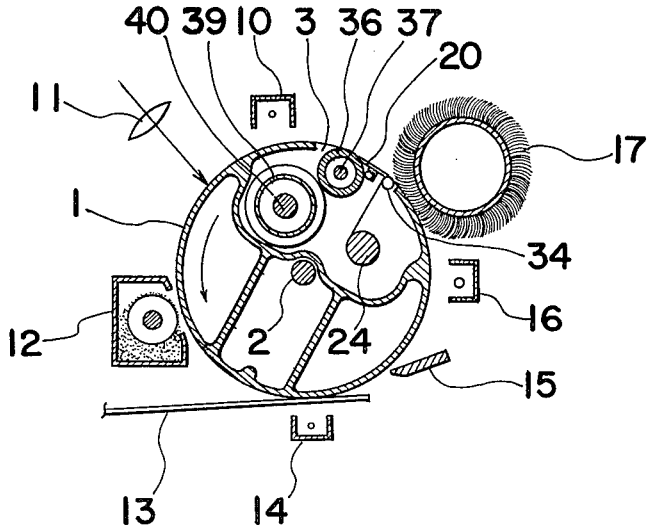
Figure 4:
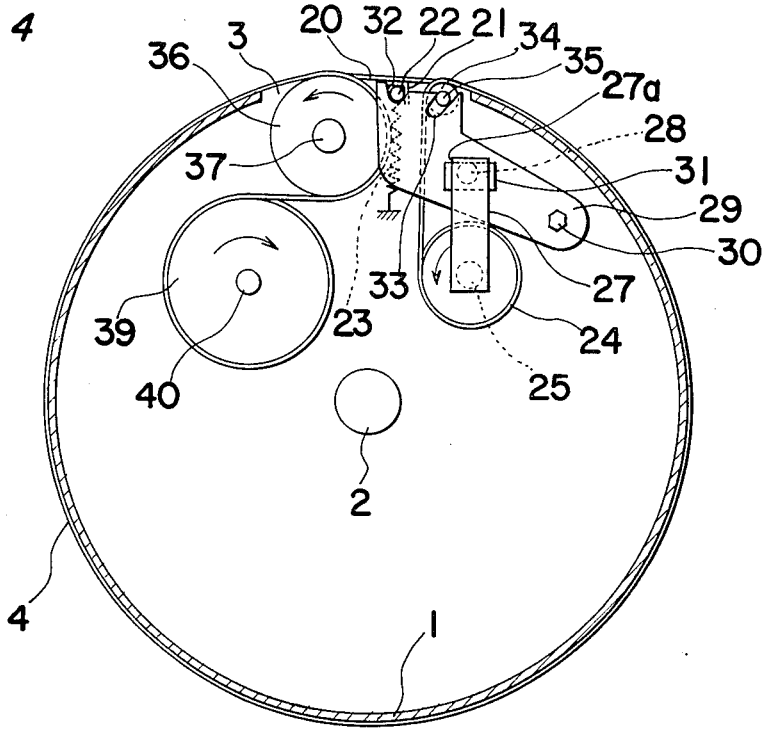
Figure 5:
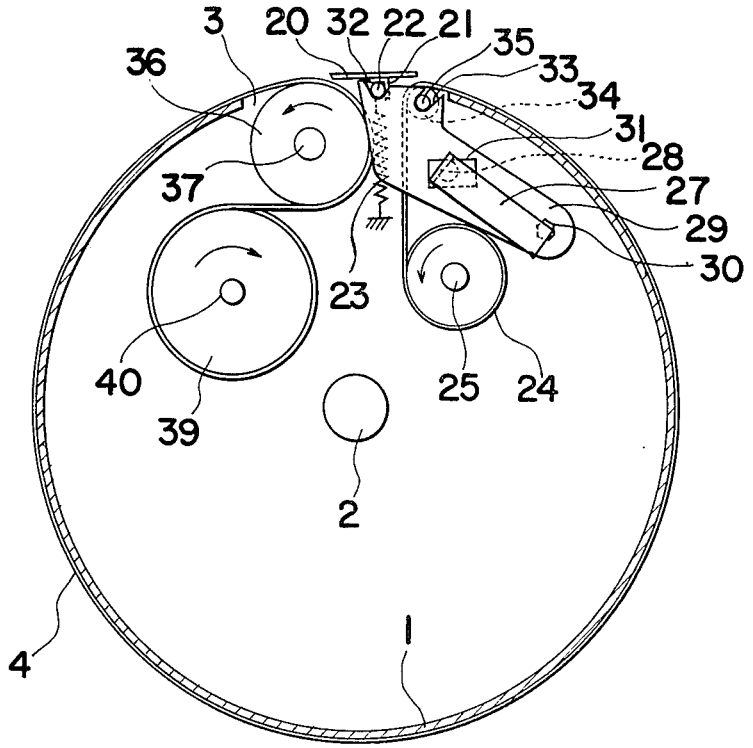
Figure 6:
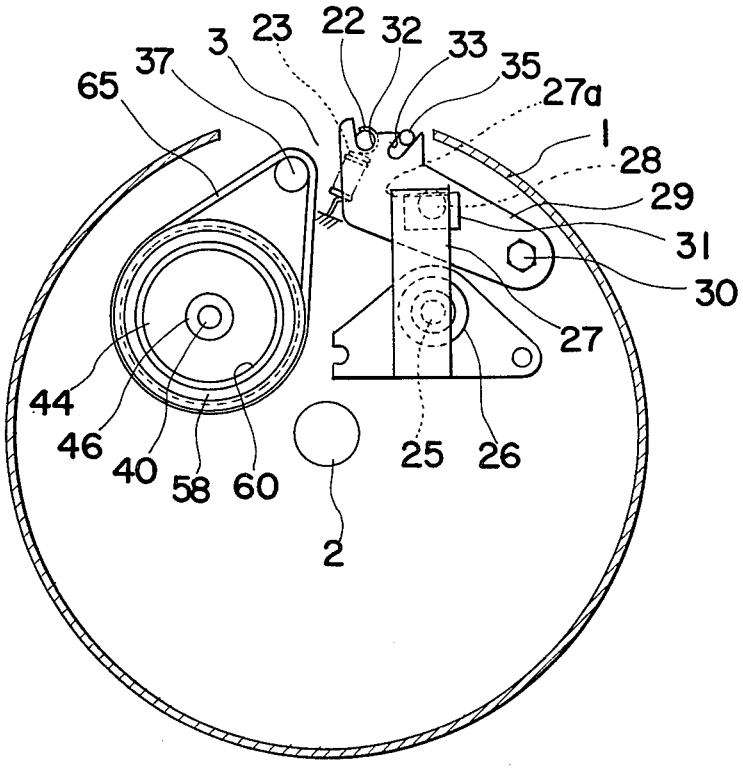
Figure 7:
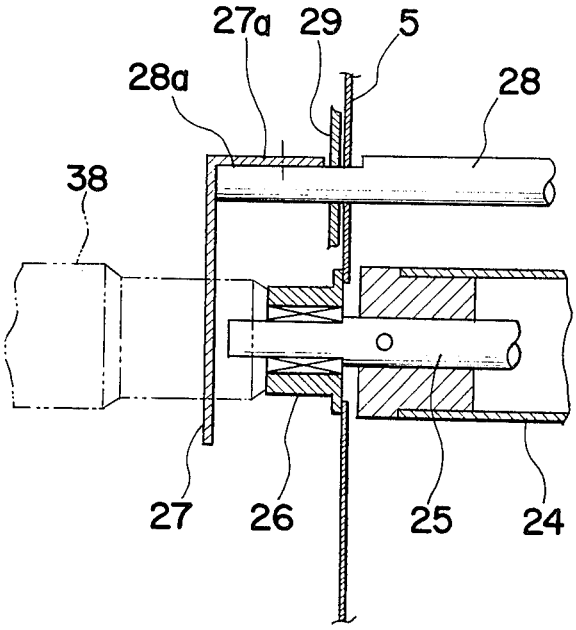
Figure 8:
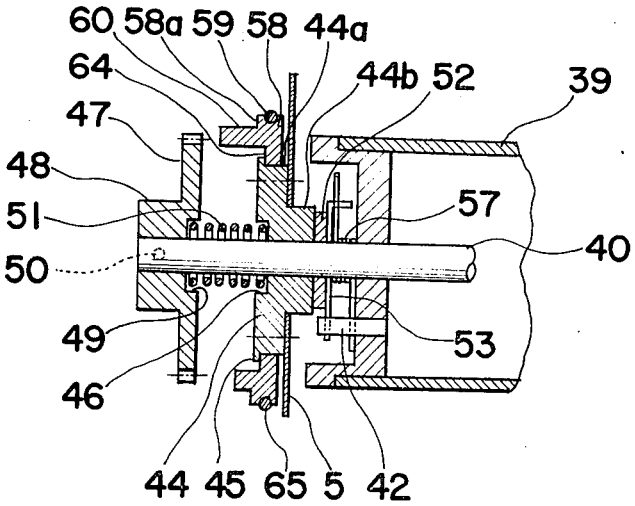
Figure 9:
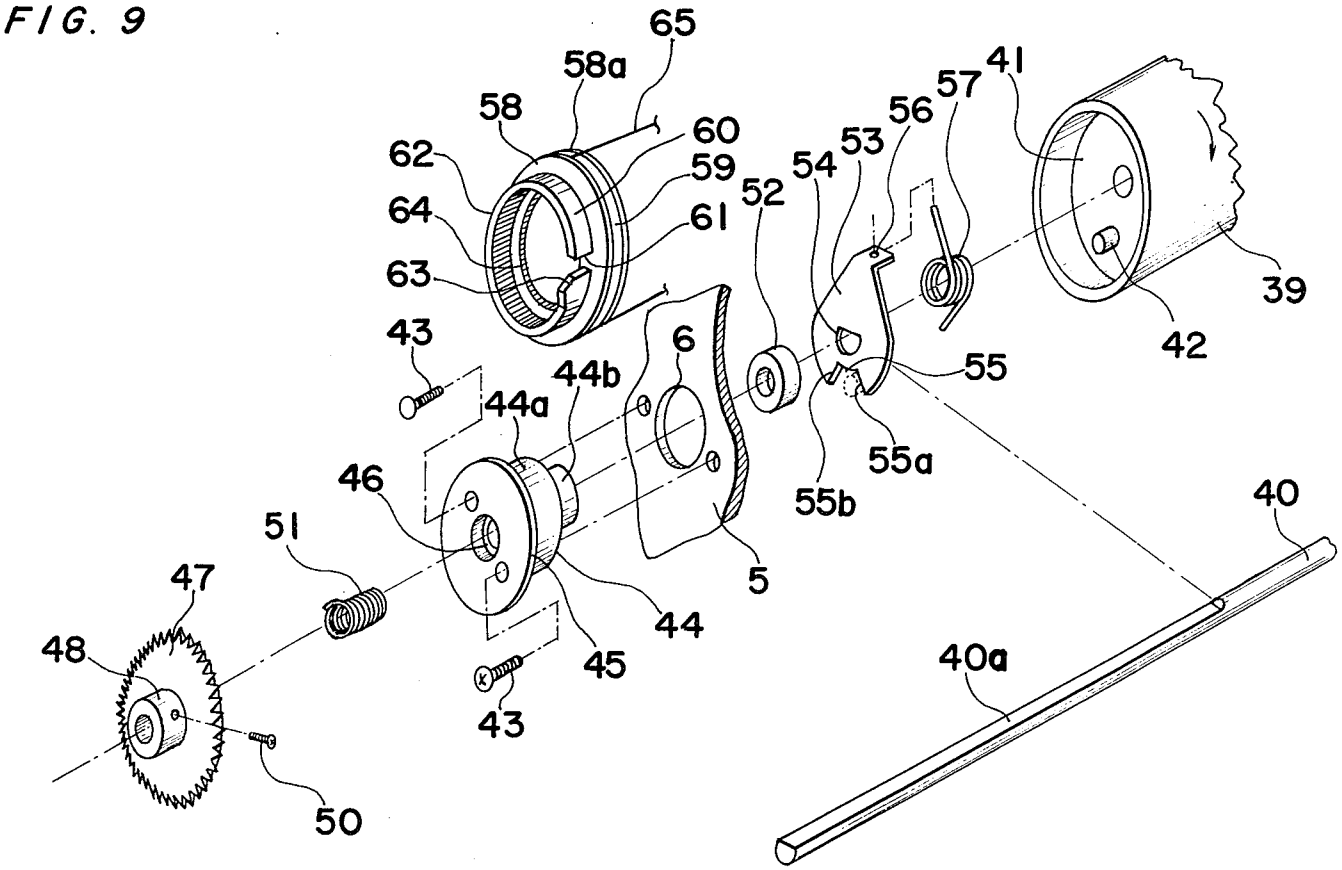
Figure 10:
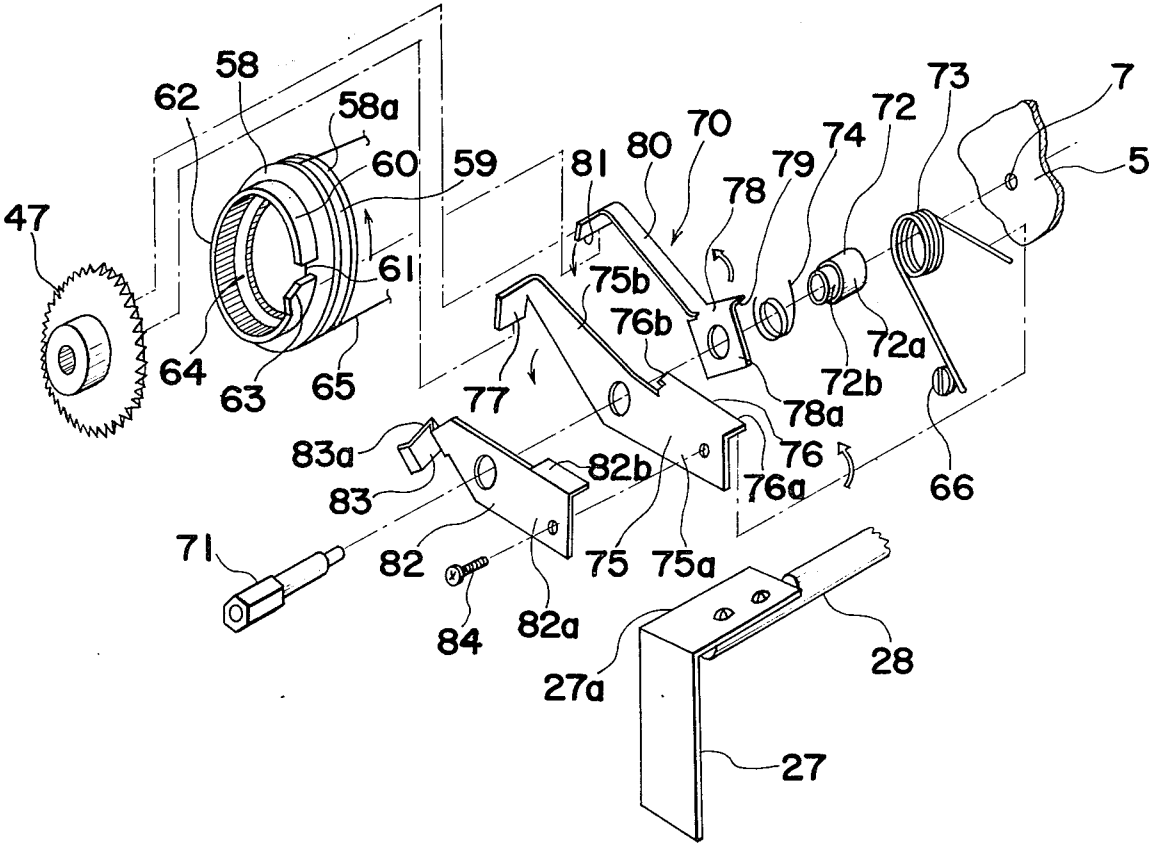
Figure 11:
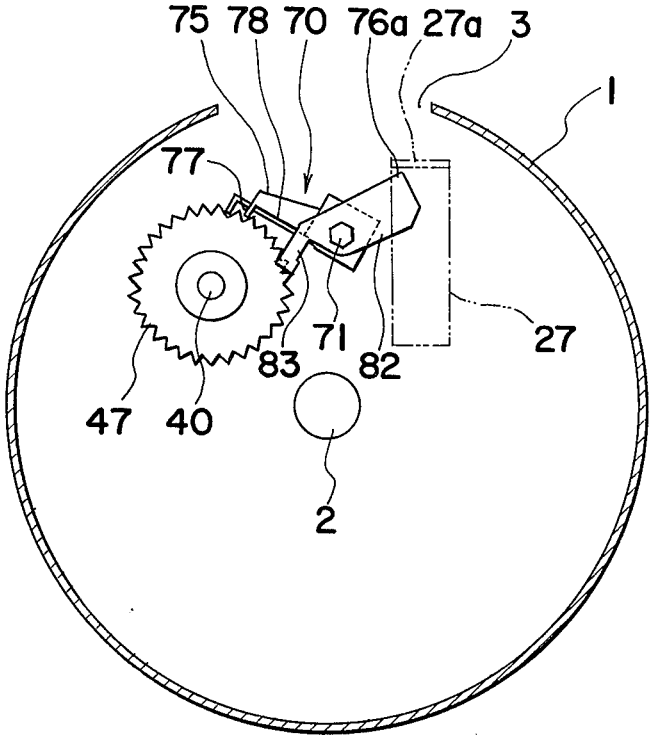
Figure 12:
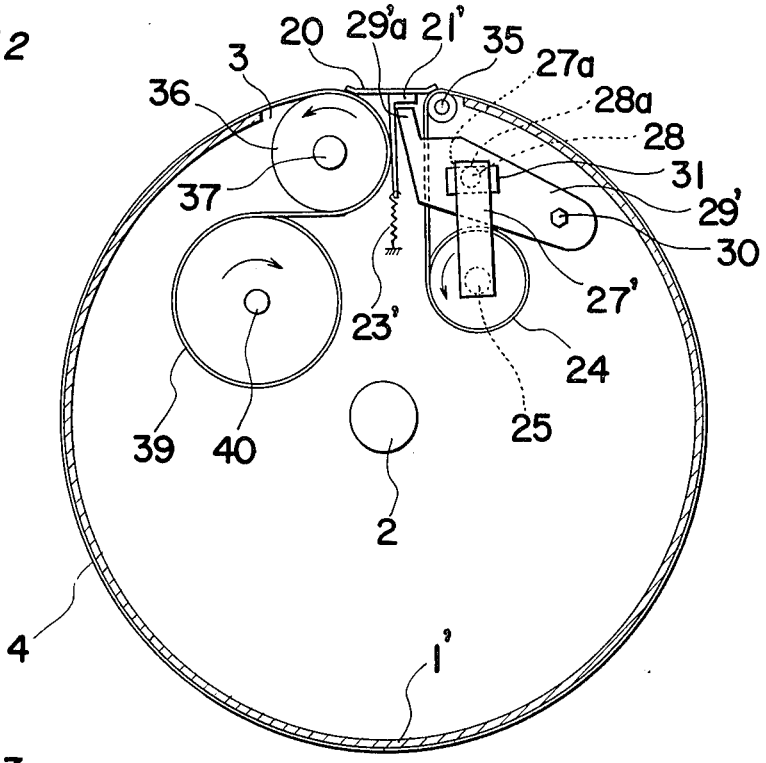
Figure 13:
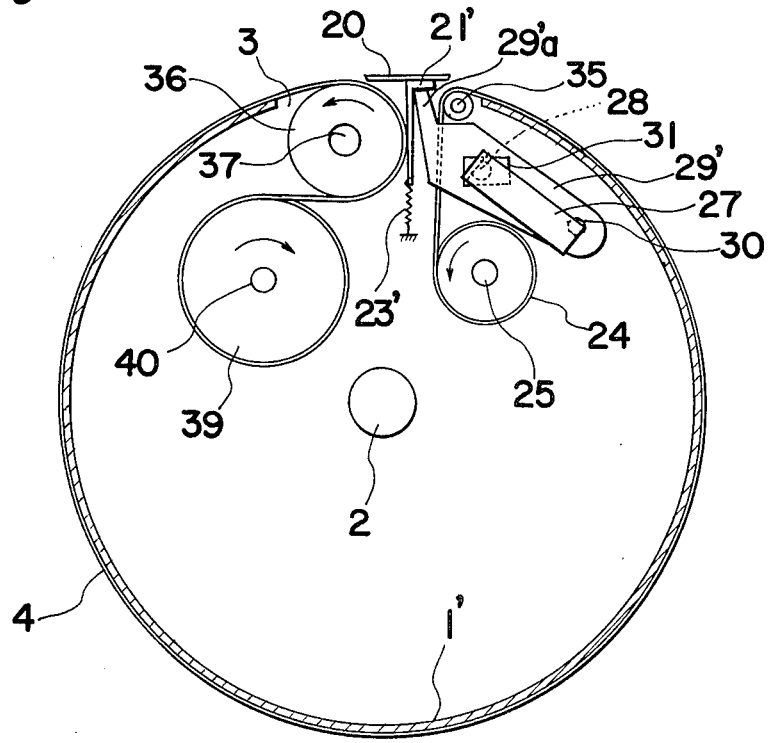

These and other objects and features of the present invention will become apparent from the following description taken in conjunction with the preferred embodiment thereof with reference to the attached drawings in which;

FIG. 1 is a schematic sectional view of a conventional photoreceptor drum which has already been referred to, FIG. 2 is a schematic sectional view of a photoreceptor drum according to one embodiment of the present invention, FIG. 3 is a schematic diagram showing, on a reduced scale, an arrangement of various processing stations around the photoreceptor drum of FIG. 2, FIGS. 4 and 5 are views similar to FIG. 2, but showing the sequence of movement of a covering member in relation to operation of moving means therefor, FIG. 6 is a view similar to FIGS. 4 and 5, but particularly shows an arrangement of moving means for the covering member, with the covering member, supply roll, takeup roll and idle rollers removed for clarity, FIG. 7 is a partial side view, partly in section, showing an arrangement of a takeup roll employed in the photoreceptor drum of FIG. 2, FIG. 8 is a partial side view, partly in section, showing an arrangement of a supply roll employed in the photoreceptor drum of FIG. 2, FIG. 9 is an exploded view showing an arrangement at one end portion of the supply roll employed in the photoreceptor drum of FIG. 2, FIG. 10 is an exploded view showing an arrangement of lock means employed in the photoreceptor drum of FIG. 2, FIG. 11 is a view similar to FIG. 6, but particularly shows an arrangement of lock means employed in the photoreceptor drum of FIG. 2, and FIGS. 12 and 13 are views similar to FIGS. 4 and 5, but particularly show a modification thereof.

Before the description of the present invention proceeds, it is to be noted that like parts are designated by like reference numerals throughout the several views of the accompanying drawings.

Referring now to FIGS. 2 to 11 there is shown in FIG. 2 a photoreceptor drum 1 equipped with a photoreceptor replacing arrangement according to one embodiment of the present invention. The drum 1 rotatably supported on a shaft 2 includes a slot 3 in a portion of the outer periphery thereof extending parallel to the drum axis, a supply roll 39 and a takeup roll 24 rotatably supported by corresponding shafts 40 and 25 within the drum 1 in a direction parallel to the drum axis, idle rollers 34 and 36 also axially, rotatably supported by corresponding shafts 35 and 37 adjacent to the slot 3, and a sheetlike photoreceptor 4 stored in roll form on the supply roll 39 and drawn out therefrom, via the idle roller 36 and through the left hand portion of the slot 3, onto the major portion of the outer periphery of the drum 1 and then wound onto the takeup roll 24 via the idle roller 34 through the right hand portion of the slot 3 as shown. Accordingly, when the takeup roll 24 is forcibly rotated counterclockwise in a manner as described later, the photoreceptor 4 paid out from the supply roll 39 slides along the outer periphery of the drum and wound onto the takeup roll 24, and the used portion of the photoreceptor 4 on the drum outer periphery is replaced by a fresh portion of the photoreceptor 4 thus paid out.

It should be noted here that the sheet-like photoreceptor 4 is stored on the supply roll 39, with the photosensitive surface 4*a* thereof directed inwardly, and upon replacement of the photoreceptor 4, a length thereof equivalent to length from a point *a* to point *b* is adapted to be wound onto the takeup roll 24. The winding of the photoreceptor 4 to the above extent is necessary because, although the portion of the photoreceptor 4 actually used for the latent image formation is limited to that from a point *c* to the point *b* on the drum outer periphery, the portion of the same photoreceptor 4 located between the point *a* and point *c* around the idle roller 36 and not directly used for the latent image formation has its photosensitive surface 4*a* exposed to the atmosphere which causes deterioration of the photosensitive characteristics thereof to a certain extent as compared with the portion of the photoreceptor 4 prior to the point a wound on the supply roll 39 and protected against influence of the atmosphere.

Still referring to FIG. 2, in the space within the slot 3 defined by the points *c* and *b* of the photoreceptor 4, there is movably disposed a resilient cover plate 20, for example, polyethylene resin such as Mylar (registered trademark) or the like, which cover plate 20 extends the length of the slot 3 for preventing toner particles and other foreign matters from entering the interior of the drum 1. The cover plate 20 is adapted to be raised upward or spaced to a certain extent from the slot 3 during the advancing of the photoreceptor 4 for smooth replacement of the photoreceptor in a manner described later.

Referring to FIG. 3, there are schematically shown various known processing devices sequentially disposed around the photoreceptor drum 1 such as a corona charger 10, an optical system 11, a developing device 12, for example, of the magnetic brush type, a transfer corona charger 14, a separating claw 15 for separating copy paper from the drum 1, a fixing device (not shown), an eraser 16 for erasing residual charge on the photoreceptor drum 1 and a cleaning device 17 for removing toner particles remaining on the drum 1. While the drum 1 rotates counterclockwise about the shaft 2, the photoreceptor 4 is uniformly charged by the corona charger 10 and is subsequently exposed to image rays from an original to be copied (not shown) through the optical system 11 to form the electrostatic latent image of the original thereon. The latent image thus formed is developed into a visible toner image by the developing device 12, and the toner image is transferred onto a copy paper sheet 13 which is transported in synchronization with the rotation of the drum 1 while having a charge imparted thereto by the transfer corona charger 14. The copy paper sheet 13 bearing the toner image thereon is separated from the drum 1 by the separating claw 15 and then discharged out of the copying apparatus into a tray (not shown) through the fixing device. Subsequently, the charge remaining on the photoreceptor drum 1 is erased by the eraser 16, with the residual toner on the photoreceptor 4 being removed by the cleaning device 17.

Referring particularly to FIGS. 4 to 7, raising or moving means for the resilient cover plate 20, winding means for the photoreceptor 4 and lock means for the supply roll 39 are described hereinbelow. The takeup roll 24 fixedly mounted on the shaft 25 is attached through the shaft 25 to a one way clutch 26 (FIGS. 6 and 7) secured on an end plate 5 of the drum 1 and is rotatable only counterclockwise. A right angled bent upper end 27*a* of an actuating lever 27 is secured, for example, by securing screws (not shown) to a flattened portion 28*a* formed adjacent to one end of a lever shaft 28 which is rotatably supported by the end plate 5, the lever 27 thus covering the front portion of the takeup roll shaft 25 when suspended and observed from the front as in FIG. 4. A rocking lever 29 connected at one end thereof to the end plate 5 by a bolt 30 for pivotal movement about the bolt 30 has a rectangular opening 31 at approximately the central portion thereof, with the actuating lever shaft 28 extending therethrough, while the flattened face 28*a* of the lever shaft 28 engages the upper edge of the opening 31. At the other end of the rocking lever 29 adjacent to the slot 3 of the drum 1, notches 32 and 33 are provided adjacent each other and in notch 32, a supporting rod 22 for supporting the resilient cover plate 20 through a supporting piece 21 is received. A coil spring 23 is extended between the supporting rod 22 and the end plate 5 for normally urging the rod 22 toward the notch 32. In the other notch 33, the shaft 35 rotatably supported by the end plate 5 for the idle roller 34 is slidably received. Needless to say, a rocking lever 29 having the rectangular opening of the same construction is provided at the other end plate of the drum with the other end of lever shaft 28 having a flattened face engaging the rectangular opening. This assures uniform raising of covering member as the two rocking levers hold both ends of the covering member. In the state shown in FIG. 4, the cover plate 20 is positioned to contact, under pressure, the photoreceptor 4 at the points *b* and *c* (FIG. 2). When the actuating lever 27 is rotated counterclockwise about the lever shaft 28, the flattened face 28*a* of the shaft 28 is also rotated together with the lever 27 and consequently, the rocking lever 29 the edge of the rectangular opening 31 of which engages the flattened face 28*a* of the shaft 28, is rotated clockwise to a predetermined extent, thus the cover plate 20 being raised outwardly from the slot 3 by the supporting rod 22 engaging the notch 32 of the rocking lever 29 and supporting piece 21 against the force of the coil spring 23. The takeup roll shaft 25 is uncovered by the movement of the actuation lever 27, and by engaging a known winding tool 38 (FIG. 7) with one end of the takeup roll shaft 25 and rotating the takeup roll 24 counterclockwise, the photoreceptor 4 can be wound onto the takeup reel 24 for replacement as described earlier. It should be noted that since the actuating lever 27 contacts the winding tool 38 during the winding i.e., during advancing of the photoreceptor 4 and is prevented from returning to its initial position, the cover plate 20 is positively maintained at its raised position. In other words, when the actuating lever 27 covers the front portion of the takeup roll shaft 25 as in FIGS. 4 and 6, the resilient cover plate 20 closely contacts the portions of the photoreceptor and seals the slot 3, and the winding tool 38 cannot be engaged with the takeup roll shaft 25. On the other hand, when the actuating lever 27 is rotated to uncover the takeup roll shaft 25 (FIG. 5), it becomes possible to effect winding of the photoreceptor 4, and the cover plate 20 is spaced from the slot 3 of the drum 1, with the cover plate 20 being locked in the raised position during winding of the photoreceptor 4.

Referring also to FIGS. 8 and 9, the supply roll 39 is rotatably supported, by a shaft 40, in a bearing 44 having a flange portion 45, a stepped portion 44*a* and a concentric reduced diameter portion 44*b* which is received in an opening 6 in the end plate 5, and which is secured to the end plate 5 by securing screws 43. The supply roll shaft 40 is provided with a flattened portion 40*a* adjacent to one end thereof, while a lock gear 47 for preventing rotation of the supply roll 39 has, at the hub portion 48 thereof secured, to the extreme end of the flattened portion 40*a* of the shaft 40 by a screw 50. A coil spring 51 for braking is disposed on the shaft 40 between concentric recesses 49 and 46 formed in the corresponding surfaces of the lock gear 47 and the bearing 44. On the shaft 40 between the bearing 44 and the end plate 41 of the supply roll 39, there are disposed a brake ring 52, a connecting plate 53 and a wire spring 57 as shown. The connecting plate 53 has a central opening 54 similar in its configuration to the cross section of the flattened portion 40*a* of the shaft 40 for simultaneous rotation therewith and is provided at one end thereof with a notch 55 which engages a pin 42 secured to an end plate 41 of the supply roll 39. One end of the wire spring 57 is received in an opening 56 formed at the other bent end of the connecting plate 53, while the other end of the spring 57 engages the pin 42 of the supply roll end plate 41 to urge the pin 42 and consequently the roll 39 counterclockwise. Accordingly, the supply roll 39, although rotatable about the shaft 40, is capable of rotating together with the shaft 40 through the connecting plate 53 by the engagement of the pin 42 with the notch 55 of the connecting plate 53 which is integrally fixed to the shaft 40 in the above described manner. The supply roll 39 is normally urged counterclockwise by the wire spring 57 as described above, i.e., in a direction opposite to the rotation of the supply roll 39 when the sheet-like photoreceptor 4 is advanced, with the pin 42 on the end plate 41 being engaged with an edge 55*a* of the notch 55 in the connecting plate 53. When the takeup roll 24 is rotated by the winding tool 38 as described earlier and the photoreceptor 4 is drawn out of the slot 3 of the drum 1 with consequent clockwise rotation of the supply roll 39, the supply roll 39 is first rotated clockwise against the urging force of the wire spring 57 until the pin 42 thereof contacts an edge 55*b* of the notch 55 in the connecting plate 53, and subsequently rotated together with the shaft 40 through the connecting plate 53 after the pin 42 has been engaged with the edge 55*b* of the notch 55. When the predetermined length of the photoreceptor 4 (equivalent to the length from the point *a* to point *b* around the outer periphery of the drum 1 in FIG. 2) has been drawn out from the supply roll 39 and the shaft 40 is locked in position by lock means described later, the supply roll 39 is urged counterclockwise by the wire spring 57 and rotates in the reverse direction, i.e., counterclockwise to a certain extent until the pin 42 contacts the edge 55*a* of the notch 55 in the connecting plate 53. This counterclockwise rotation of the supply roll 39 imparts back tension to the photoreceptor 4 for preventing slack thereof. A cam ring 58 has a collar portion 58*a* having an annular groove 59 in the outer periphery thereof, a cylindrical cam portion 60 of reduced diameter extending outwardly from one surface of the collar portion 58*a* concentric with the cam ring and has a notch 61 in the periphery thereof, and an inner ring 64 defined by the cam portion 60 and the collar portion 58*a* and having a smaller diameter than the inner diameter of the cam portion 60 as shown, and the cam ring is rotatably mounted, at the inner ring 64 thereof, on the stepped portion 44*a* of the bearing 44 and is held in position between the flange portion 45 of the bearing 44 and the end plate 5. The cam portion 60 having an external diameter slightly larger than that of the lock gear 47 is disposed adjacent to said gear 47 in the assembled condition shown in FIG. 8 and is further provided with an angular projection 63 at the outer edge 62 thereof in a position adjacent to the notch 61, while a cam ring driving belt 65 which is connected to the shaft 37 (FIG. 6) of the idle roller 36 is passed around the annular groove 59 of the cam ring 58.

Referring also to FIGS. 10 and 11, the lock means 70 generally includes a sleeve 72 having a large diameter portion 72*a* and a reduced diameter portion 72*b* and supported by a bolt 71 threaded into a threaded opening 7 in the end plate 5, a wire spring 73 mounted on the large diameter portion 72*a* of the sleeve 72, and a second lock claw member 78, a first lock claw member 75 and stop 82 pivotally mounted on the reduced diameter portion 72*b* with another wire spring 74. The first lock claw member 75 which is, for example, of metallic material has a generally rectangular base portion 75*a*, an arm portion 75*b* extending forwardly and slightly upwardly from the base portion 75*a* and a claw 77 formed at a forward end of the arm portion 75*b*, with a right angled bent portion 76 being formed along an upper edge of the base portion 75*a*, while the second lock claw member 78 of similar material to the first claw member 75 also has a generally square base portion 78*a* the upper edge of which is bent to form an arm portion 80 extending forwardly and slightly upwardly from the bent portion, with a claw 81 being formed at a forward end of the arm portion 80. The stop member 82, for example, of sheet metal also has a base portion 82*a* and a bent portion 82*b* formed along an upper edge of the base portion 82*a*, and is provided with a claw-like folded portion 83 at a forward end thereof. The stop member 82 is fixed to one side of the first lock claw member 75 by a screw 84. Each of the members 75, 78 and 82 has a central opening for allowing the bolt 71 to pass therethrough. One end of the spring 73 engages a securing screw 66 securing the one way clutch 26 for the takeup roll 24 to the end plate 5, while the other end of the same spring 73 contacts the under surface of the bent portion 76 of the first lock claw member 75. Accordingly, the first lock claw member 75 is normally urged counterclockwise about the bolt 71, and the claw 77 thereof engages the lock gear 47, while the rear end of the claw member 75 contacts, at the extreme end 76*a* of the bent portion 76 thereof, the under surface of the right angled bent upper portion 27*a* of the actuating lever 27. The second lock claw member 78 is pivotable correlatively with the first lock claw member 75 and is normally urged counterclockwise about the bolt 71 by the wire spring 74 one end of which engages the end 76*b* of the bent portion 76 of the first lock claw member 75 and the other end of which contacts the rear portion 79 of the second lock claw member 78. The urging force of the spring 74 is restricted by the contact of the under surface of the arm portion 80 of the second lock claw member 78 with an upper edge 83*a* of the folded portion 83 of the stop member 82, while the claw 81 of the second lock claw member 78 is engageable with the outer periphery of the cam portion 60 of the cam ring 58 and also with the lock gear 47. In the above described lock means 70, when the actuating lever 27 is rotated counterclockwise as described earlier for engaging the winding tool 38 with the shaft 25 of the takeup roll 25, the first lock claw member 75 is pivoted clockwise against the urging force of the wire spring 73 by the depression of the end 76*a* of the bent portion 76 of the member 75 by the under surface of the right angled bent upper portion 27*a* of the actuating lever 27, while the second lock claw member 78 is also pivoted clockwise by the urging force imparted by the stop member 82 rotated as one unit with the first lock claw member 75, and thus the claw 77 of the first lock claw member 75 is disengaged from the lock gear 47, and the claw 81 of the second lock claw member 78 leaving the gear 47 and also the notch 61 of the cam portion 60 of the cam ring 58. Subsequently, when the takeup roll 24 is rotated by the winding tool 38 for drawing the photoreceptor 4 out of the supply roll 39 and for sequentially winding the photoreceptor 4 onto the takeup roll 36 as described earlier, the idle roller 36 is also caused to rotate counterclockwise together with the shaft 37 thereof, which rotation of the idle roller 36 is transmitted to the cam ring 58 through the belt 65 directed around the shaft 37 and the annular groove 59 formed in the collar portion 58*a* of cam ring 58, thus causing the cam ring 58 to rotate counterclockwise. Immediately before the cam ring 58 completes one rotation, the folded portion 83 of the stopper member 82 rides over the angular projection 63 formed in the outer edge 62 of the cam portion 60 of the cam ring 58, while the second lock claw member 78 which is then released from the restraint by the stop member 82 is pivoted counterclockwise to a certain extent by the force of the wire spring 74, with the claw 81 thereof contacting the outer periphery of the cam portion 60. When the cam ring 58 has completed one rotation, the claw 81 of the second lock claw member 78 enters the notch 61 in the cam portion 60, with simultaneous engagement of the same claw 81 with the lock gear 47. Thus the gear 47 is brought into the locked state, and the supply roll 39 stops rotation to complete the advancing of the photoreceptor 4. Subsequently, when the actuating lever 27 is returned to the original vertical position as shown in FIGS. 4 and 6, the first lock claw member 75 pivots counterclockwise due to the force of the wire spring 73 following the returning movement of the lever 27, and the claw 77 of the claw member 75 engages the lock gear 47.

It will be understood from the foregoing description that the replacement of the photoreceptor 4 is effected by the drawing out of the photoreceptor 4 from the supply roll 39 in an amount corresponding to one rotation of the cam ring 58 which rotates in association with the rotation of the idle roller 36, and the length of the photoreceptor 4 to be drawn out from the supply roll 39 is equivalent to the length of the same from the point a to point b along the outer periphery of the drum 1 (FIG. 2). Accordingly, to satisfy the above described relation, it is necessary to establish the following ratio in the dimensions of the elements invloved. Diameter of the idle roller shaft 37:diameter of the annular groove 59 of the cam ring " external circumference of the idle roller 36:length of the photoreceptor 4 between the points *a* and *b*.

As is clear from the foregoing description, according to the photoreceptor drum of the present invention, the cover plate for closing the slot during use of the photoreceptor drum for copying purpose is adapted to be raised or spaced from the slot for the replacement of the photoreceptor upon rotation of the actuating lever preparatory to engagement of the winding tool, while the supply member for the photoreceptor has lock means for associating the raising of the cover plate with the lock releasing operation of the lock means, and therefore, not only is the undesirable entry of toner particles and the like into the drum interior positively prevented, but erroneous movement of the cover plate during the replacing of the photoreceptor is advantageously eliminated, so that highly reliable protection against damages to the photoreceptor is achieved by a simple construction.

Referring to FIGS. 12 and 13, there is shown a photoreceptor drum 1' equipped with a modified photoreceptor replacing arrangement according to the present invention. In this modification, the notches 32 and 33 described as being provided at the end of the rocking lever 29 in the embodiment of FIGS. 2 to 11 are replaced by a projecting portion 29'*a* at the corresponding end of a rocking lever 29' having similar construction to the lever 29. Meanwhile, the supporting piece 21 and the supporting rod 22 described as employed in the embodiment of FIGS. 2 to 11 are replaced by a supporting member 21' connected at one end thereof to the cover plate 20, with a spring member 23' being extended between the other end of the member 21' and the end plate 5. In the above modification, when the actuating lever 27 is rotated counterclockwise about the lever shaft 28, the flattened surface 28*a* of the shaft 28 is rotated together with the lever 27 in the same manner as described with reference to the embodiment of FIGS. 2 to 11 and the rocking lever 29' the edge of the rectangular opening 31 of which engages the flattened surface 28*a* of the shaft 28 is rotated clockwise to a predetermined extent, with the tip of the projecting portion 29'*a* thereof contacting the under surface of the supporting member 21' so as to raise the cover plate 20 outwardly from the slot 3 against the urging force of the spring member 23'. The remainder of the construction, function and effect of the raising means for the cover plate 20, winding means for the photoreceptor 4 and lock means for the supply roll 39 are the same as those described with reference to the embodiment of FIGS. 2 to 11, so that a detailed description thereof is omitted for brevity.

It should be noted here that the rectangular opening in the rocking lever, and the actuating lever shaft having the flattened portion described as employed in the foregoing embodiments for causing the rocking lever to pivot for raising the cover plate may be replaced by any other arrangement, for example, a pin fixed to the actuating lever and an arcuate slot or groove in the rocking lever in which the pin is engaged so long as such arrangements serve the purpose of the present invention.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. In a photoreceptor drum for use in an electrophotographic copying apparatus which includes a rotatory cylindrical drum member having a slot in the outer periphery thereof parallel to the drum axis, a supply roll member and a takeup roll member rotatably disposed in said cylindrical drum member, a sheet-like photoreceptor having one end thereof attached to said supply roll member and the other end thereof attached to said takeup roll member, a supply of said sheetlike photoreceptor being wound around said supply roll member and drawn out therefrom through said slot and along the outer periphery of said cylindrical drum and wound onto said takeup roll member upon rotation thereof for replacement of said photoreceptor, and means covering said slot, the improvement comprising covering means being selectively movable between a first position covering said slot and a second position remote from said slot, means for moving said covering means between said first and second positions for raising said covering means from said first position to said second position at the time of replacement of said sheet-like photoreceptor, lock means having a lock gear connected to one end of said supply roll, a locking claw member engagable with said lock gear for locking said supply roll against rotation, and a cylindrical rotatable cam member having a notch and having said claw member engaged with the outer periphery thereof, and means for associating the releasing of said claw member from said lock gear and from said notch with said moving means for raising said covering means, whereby said cam member is rotated during the replacement of sheet-like photoreceptor from said supply roll, during which rotation said claw member is disengaged from said notch by said associating means, and said claw member is engaged with said notch after a predetermined amount of said sheet-like photoreceptor is drawn off said supply roll.

2. In a photoreceptor drum for use in an electrophotographic copying apparatus which includes a rotary cylindrical drum member having a slot in the outer periphery thereof parallel to said drum axis, a supply roll member and a take-up roll member rotatably disposed in said drum member, a sheet-like photoreceptor having one end thereof attached to said supply roll member and the other end thereof attached to said take-up roll member, a supply of said sheet-like photoreceptor being wound around said supply roll member and drawn out therefrom through said slot and along the outer periphery of said drum member and wound onto said take-up roll member upon rotation thereof for replacement of said photoreceptor, and means covering said slot, the improvement which comprises:

said covering means being selectively movable between a closed position, in which said slot is closed by said covering means, and an opened position in which said covering means is spaced a distance from said slot to open the latter;

a winding tool removably connectable to said take-up roll member for rotating said take-up roll member, when connected to said take-up roll member and subsequently rotated in a predetermined direction, to wind the photoreceptor onto said take-up roll member;

said take-up roll member having an engagement portion engageable with the winding tool for connection of said winding tool to said take-up roll member;

means for moving said covering means between said closed and opened positions and operable to move said covering means from said closed position to said opened position when the replacement of the photoreceptor is to be effective, said moving means including an actuating lever pivotally supported in said drum member for movement between a first position in which it blocks engagement of the winding tool with said engagement portion, and a second position in which said engagement portion is exposed in readiness for connection of the winding tool to the take-up roll member, said covering means when said actuating lever is in said first position being held in said closed position and, when said actuating lever is in said second position being held in said opened position;

whereby said winding tool is connectable to said engagement portion on said take-up roll member only when said actuating lever is in said second position and said winding tool when connected to said take-up roll member prevents said actuating lever from returning towards said first position.

3. A photoreceptor drum as claimed in claim 2, wherein said covering means includes supporting member and a resilient cover plate member fixed on said supporting member and having a size sufficient to cover said slot, said resilient cover plate member when brought into said first position through movement of said covering means, closely contacting the surface of said sheet-like photoreceptor which passes through said slot.

4. A photoreceptor drum as claimed in claim 3, wherein said resilient cover plate member is made of polyethylene resin.

5. In a photoreceptor dum for use in an electrophotographic copying apparatus which includes a rotary cylindrical drum member having a slot in the outer periphery thereof parallel to said drum axis, a supply roll member and a take-up roll member rotatably disposed in said drum member, a sheet-like photoreceptor having one end thereof attached to said supply roll member and the other end thereof attached to said take-up roll member, a supply of said sheet-like photoreceptor being wound around said supply roll member and drawn out therefrom through said slot and along the outer periphery of said drum member and wound onto said take-up roll member upon rotation thereof for replacement of said photoreceptor, and means covering said slot, the improvement which comprises:

said covering means being selectively movable between a closed position, in which said slot is closed by said covering means, and an opened position in which said covering means is spaced a distance from said slot to open the latter;

means for moving said covering means between said closed and opened positions and operable to move said covering means from said closed position to said opened position when the replacement of the photoreceptor is to be effective;

means for locking said supply roll member to prevent rotation of said supply roll member;

a winding tool removably connectable to said takeup roll member for rotating said take-up roll member, when connected to said take-up roll member and subsequently rotated in a predetermined direction, to wind the photoreceptor onto said take-up roll member;

said take-up roll member having an engagement portion with which said winding tool is engageable for connection of said winding tool to said take-up roll member; and associating means for associating said moving means with said locking means for moving said moving means to move said covering means to the opened position when said locking means is disengaged, said associating means including an actuating lever said engagement portion of the take-up roll member is from access by said winding tool, and a second position in which said engagement portion is exposed in readiness for connection of the winding tool to the take-up roll member, and said actuating lever moving from said first position to said second position as said covering means is moved to said opened position and said locking means being disengaged from said supply roll member;

whereby said winding tool is connectable to said engagement portion on said take-up roll member only when said actuating lever is in said second position, and when said winding tool is connected to said take-up roll member it prevents said actuating lever from returning towards said first position.

6. A photoreceptor drum as claimed in claim 5, wherein said covering means includes supporting member and a resilient cover plate member fixed on said supporting member and having a size sufficient to cover said slot, said resilient cover plate member when brought into said first position through movement of said covering means, closely contacting the surface of said sheet-like photoreceptor which passes through said slot.

7. A photoreceptor drum as claimed in claim 6, wherein said resilient cover plate member is made of polyethylene resin.

8. A photoreceptor drum as claimed in claim 5, further including means for controlling amount of said sheet-like photoreceptor paid out from said supply roll member, said control means being coupled to and actuated by said associating means and comprising means for detecting when a predetermined amount of said photoreceptor has been paid out and for thereupon locking said supply roll member.

9. In photoreceptor drum for use in an electrophotographic copying apparatus which includes a rotary cylindrical drum member having a slot in the outer periphery thereof parallel to said drum axis, a supply roll member and a take-up roll member rotatably disposed in said drum member, a sheet-like photoreceptor having one end thereof attached to said supply roll member and the other end thereof attached to said take-up roll member and drawn out therefrom through said slot and along the outer periphery of said drum member and wound onto said take-up roll member upon rotation thereof for replacement of said photoreceptor, and means covering said slot, the improvement thereof which comprises:

said covering means being selectively movable between a closed position, in which said slot is closed by said covering means, and an opened position in which said covering means is spaced a distance from said slot to open the latter;

means for moving said covering means between said closed and opened positions and operable to move said covering means from said closed position to said opened position when the replacement of the photoreceptor is to be effected, said moving means including a cam follower engageable with said covering means and a cam member engageable with said cam follower;

means for locking said supply roll member to prevent rotation of said supply roll member, said locking means including a lock gear coaxially mounted on one end of the supply roll member and a lock pawl member engageable with said lock gear;

a manipulatable winding tool removably connectable to said take-up roll member for, said winding tool rotating said take-up roll member, when manually connected to said take-up roll member and subsequently rotated in a predetermined direction, to wind the photoreceptor onto said take-up roll member;

said take-up roll member having an engagement portion with which said winding tool is engageable for connection of said winding tool to said take-up roll member;

associating means for associating said moving means with said locking means for moving said moving means to move said covering means to the opened position when said locking means is disengaged, said associating means including an actuating lever supported pivotally for movement between a first position in which it shields said engagement portion of the take-up roll member from access by said winding tool, and a second position in which said engagement portion is exposed in readiness for connection of the winding tool to the take-up roll member, said actuating lever carrying said cam member coaxially supported thereby and said lock pawl member being positioned for engagement by said actuating lever, and said actuating lever moving from said first position to said second position and cam member being rotated simultaneously with the movement of said covering means from the closed position to the opened position and said lock pawl member being disengaged from said lock gear;

whereby said winding tool is connectable to said engagement portion on said take-up roll member only when said actuating lever is in said second position, and when said winding tool is connected to said take-up roll member it prevents said actuating lever from returning towards said first position.

10. A photoreceptor drum as claimed in claim 9, wherein said covering means includes supporting member and a resilient cover plate member fixed on said supporting member and having a size sufficient to cover said slot, said resilient cover plate member when brought into said first position through movement of said covering means, closely contacting the surface of said sheet-like photoreceptor which passes through said slot.

11. A photoreceptor drum as claimed in claim 10, wherein said resilient cover plate member is made of polyethylene resin.

12. A photoreceptor as claimed in claim 9, further includung means for controlling amount of said sheet-like photoreceptor paid out from said supply roll member, said control means being coupled to and actuated by said associating means and comprising means for detecting when a predetermined amount of said photoreceptor has been paid out and for thereupon locking said supply roll member.

* * * * *